US008442242B2

(12) United States Patent
Harwood

(10) Patent No.: US 8,442,242 B2
(45) Date of Patent: May 14, 2013

(54) ACOUSTIC REFLECTOR

(76) Inventor: Ronald Paul Harwood, Farmington Hills, MI (US)

( * ) Notice: Subject to any disclaimer, the term of this patent is extended or adjusted under 35 U.S.C. 154(b) by 131 days.

(21) Appl. No.: 12/888,545

(22) Filed: Sep. 23, 2010

(65) Prior Publication Data

US 2012/0076328 A1 Mar. 29, 2012

(51) Int. Cl.
*H04R 25/00* (2006.01)

(52) U.S. Cl.
USPC ..... 381/160; 381/337; 381/345; 181/176

(58) Field of Classification Search ..... 381/160, 381/334, 337, 345, 352, 386; 181/176, 198, 181/191
See application file for complete search history.

(56) References Cited

U.S. PATENT DOCUMENTS

| | | | | |
|---|---|---|---|---|
| 3,326,321 | A | 6/1967 | Valuch | |
| 3,329,235 | A | 7/1967 | Shaper | |
| 3,818,138 | A | 6/1974 | Sperrazza, Jr. | |
| 4,063,387 | A | 12/1977 | Mitchell | |
| 4,200,904 | A | 4/1980 | Doan | |
| 4,348,549 | A | 9/1982 | Berlant | |
| 4,474,258 | A * | 10/1984 | Westlund | 181/151 |
| 5,418,336 | A | 5/1995 | Negishi et al. | |
| 5,525,767 | A | 6/1996 | Fields | |
| 5,721,401 | A | 2/1998 | Sim | |
| 5,832,099 | A | 11/1998 | Wiener | |
| 5,988,314 | A | 11/1999 | Negishi | |
| 5,995,634 | A | 11/1999 | Zwolski | |
| 6,257,365 | B1 | 7/2001 | Hulsebus, II | |
| 6,345,685 | B1 | 2/2002 | Wells et al. | |
| 6,461,752 | B1 | 10/2002 | Leung | |
| 6,598,842 | B1 | 7/2003 | Yeh | |
| 6,738,483 | B1 * | 5/2004 | Betts | 381/160 |
| 6,769,509 | B2 | 8/2004 | Harwood | |
| 6,957,715 | B2 | 10/2005 | Christiansen | |
| 7,219,873 | B2 | 5/2007 | Harwood | |
| 7,606,379 | B2 | 10/2009 | Ivey et al. | |
| 7,607,512 | B2 | 10/2009 | Harwood | |
| 8,098,852 | B2 * | 1/2012 | Harwood et al. | 381/160 |
| 2004/0070518 | A1 | 4/2004 | Whittle, Jr. et al. | |
| 2006/0043737 | A1 | 3/2006 | Ashikian | |

(Continued)

FOREIGN PATENT DOCUMENTS

| | | |
|---|---|---|
| GB | 1460753 | 1/1977 |
| JP | H1096535 A | 4/1998 |

(Continued)

OTHER PUBLICATIONS

International Search Report and Written Opinion for corresponding Application No. PCT/US2011/053042, mailed Apr. 25, 2012, 9 pages.

(Continued)

*Primary Examiner* — Brian Ensey
*Assistant Examiner* — Sabrina Diaz
(74) *Attorney, Agent, or Firm* — Brooks Kushman P.C.

(57) ABSTRACT

A speaker assembly is provided with a speaker and a reflector spaced apart from the speaker. The reflector faces the speaker. The reflector has a central region and a plurality of circumferentially spaced lobes. Each lobe extends radially outward from the central region for reflecting acoustic vibrations from the speaker radially outboard from the reflector. Gaps are provided between the lobes for permitting acoustic vibrations to pass through the gaps.

20 Claims, 5 Drawing Sheets

U.S. PATENT DOCUMENTS

| | | | | |
|---|---|---|---|---|
| 2006/0231328 | A1 | 10/2006 | Moore | |
| 2007/0045040 | A1 * | 3/2007 | Harwood | 181/199 |
| 2009/0267540 | A1 | 10/2009 | Chemel et al. | |
| 2010/0162685 | A1 | 7/2010 | Hirshberg | |

FOREIGN PATENT DOCUMENTS

| | | | |
|---|---|---|---|
| KR | 20-2009-0000060 | * | 1/2009 |
| KR | 2020090000034 | U | 1/2009 |
| KR | 2020090000060 | U | 1/2009 |

OTHER PUBLICATIONS

International Search Report and Written Opinion for Application No. PCT/US10/58896, mailed Apr. 8, 2011, 10 pages.
Office Action for Application No. 12/631,943, mailed May 23, 2011, 16 pages.
U.S. Appl. No. 12/631,943, Acoustic Reflector and Energy Storage for Media Assemblies, filed Dec. 7, 2009, 29 pages.
Soundsphere Loudspeakers, Model 110B Loudspeaker, 2008, Sonic Systems, Inc., 2 pages.
Soundsphere Loudspeakers, Model Q-6 Loudspeaker, 2006, Sonic Systems, Inc., 2 pages.
Soundsphere Loudspeakers, Model Q-8 Loudspeaker, 2007, Sonic Systems, Inc., 2 pages.
Soundsphere Loudspeakers, Model Q-12A Loudspeaker, 2008, Sonic Systems, Inc., 2 pages.
Soundsphere Loudspeakers, Model Q-15 Loudspeaker, 2008, Sonic Systems, Inc., 2 pages.
Soundsphere Loudspeakers, Model Q-LB Loudspeaker, 2006, Sonic Systems, Inc., 2 pages.
Soundsphere Loudspeakers, Model Q-SB2 Loudspeaker, 2008, Sonic Systems, Inc., 2 pages.
International Preliminary Report on Patentability for corresponding Application No. PCT/US11/53042, mailed Feb. 14, 2013, 9 pages.

* cited by examiner

ACOUSTIC REFLECTOR

TECHNICAL FIELD

Various embodiments relate to acoustic reflectors.

BACKGROUND

Many outdoor and indoor public areas utilize speakers, speaker systems or public address systems for reproducing sound in these areas. These areas may include city streets, parks, residential neighborhoods, office buildings, campus areas, exterior walkways, shopping malls, casinos, atriums, and the like. These areas typically utilize speakers or speaker systems that are mounted to existing building structures, structural poles, or the like. Much effort is employed in installation of these systems and protecting these speaker systems from vandalism, wind load and/or the weather. Also, efforts have been directed towards protecting the associated wires or cables provided to these speaker systems. The prior art provides a plurality of methods and apparatuses for mounting speakers and speaker systems in public areas. The prior art also provides apparatuses for protecting these speakers from the elements. Further, the prior art has offered solutions for concealing speakers systems in public areas. Two prior art examples include Harwood U.S. Pat. No. 6,769,509 B2; and Harwood U.S. Pat. No. 7,219,873 B2.

SUMMARY

According to at least one embodiment, a speaker assembly is provided with a speaker and a reflector spaced apart from the speaker. The reflector faces the speaker. The reflector has a central region and a plurality of circumferentially spaced lobes. Each lobe extends radially outward from the central region for reflecting acoustic vibrations from the speaker radially outboard from the reflector. Gaps are provided between the lobes for permitting acoustic vibrations to pass through the gaps.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
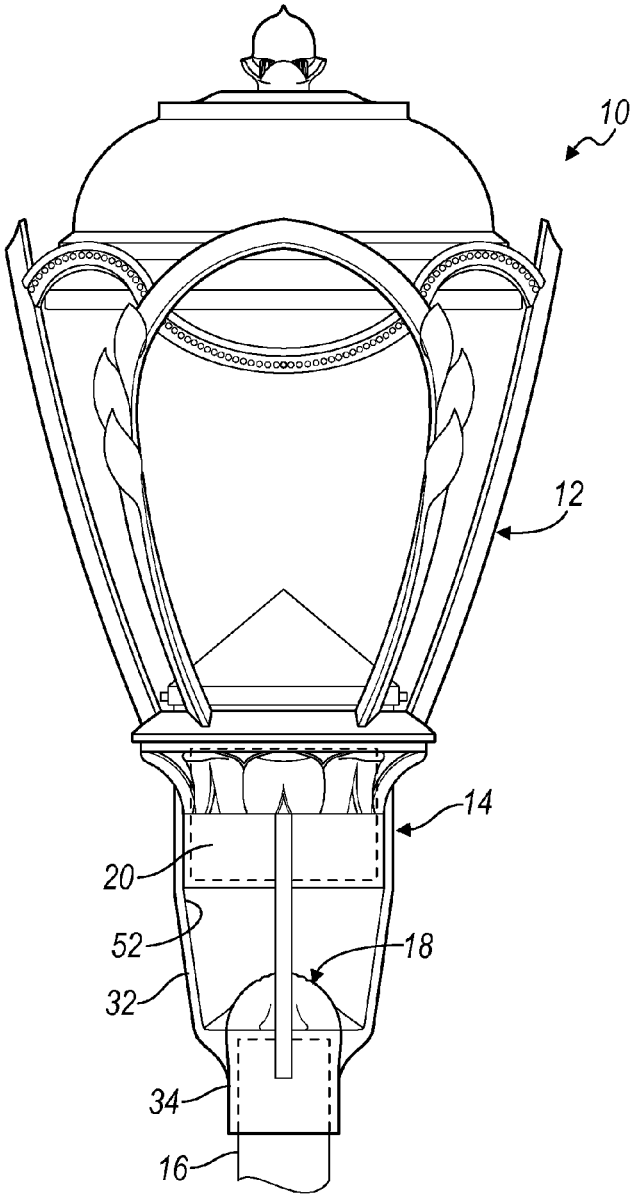
FIG. 1 is a front side elevation view of a media assembly according to an embodiment.

Referring now to FIG. 1, a media assembly is illustrated according to at least one embodiment and is referenced generally by numeral 10. The media assembly 10 includes a combination of a luminaire 12 and a speaker assembly 14. The luminaire 12 and the speaker assembly 14 are illustrated mounted upon a structural pole 16 for supporting the luminaire 12 and the speaker assembly 14 upon an underlying support surface and for elevating the luminaire 12 and the speaker assembly 14 above the underlying support surface. Although the media assembly 10 is illustrated mounted to the structural pole 16, the invention contemplates various structural supports for the media assembly, including street poles, light poles, sign poles, direct surface mounting, pendant lighting, catenary lighting, or the like.

Prior art speaker assemblies that focus a single speaker directly downward provide an uneven range of coverage. The speaker assembly 14 utilizes a reflector 18 for transmitting the acoustic vibrations with even distribution.

Figure 2:
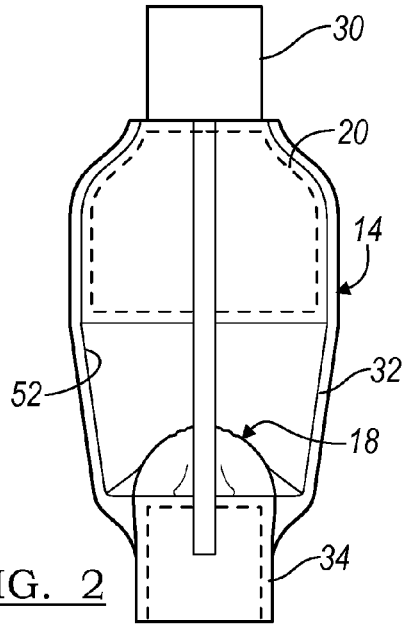
FIG. 2 is a front side elevation view of the media assembly of FIG. 1 illustrated partially disassembled.
Figure 3:
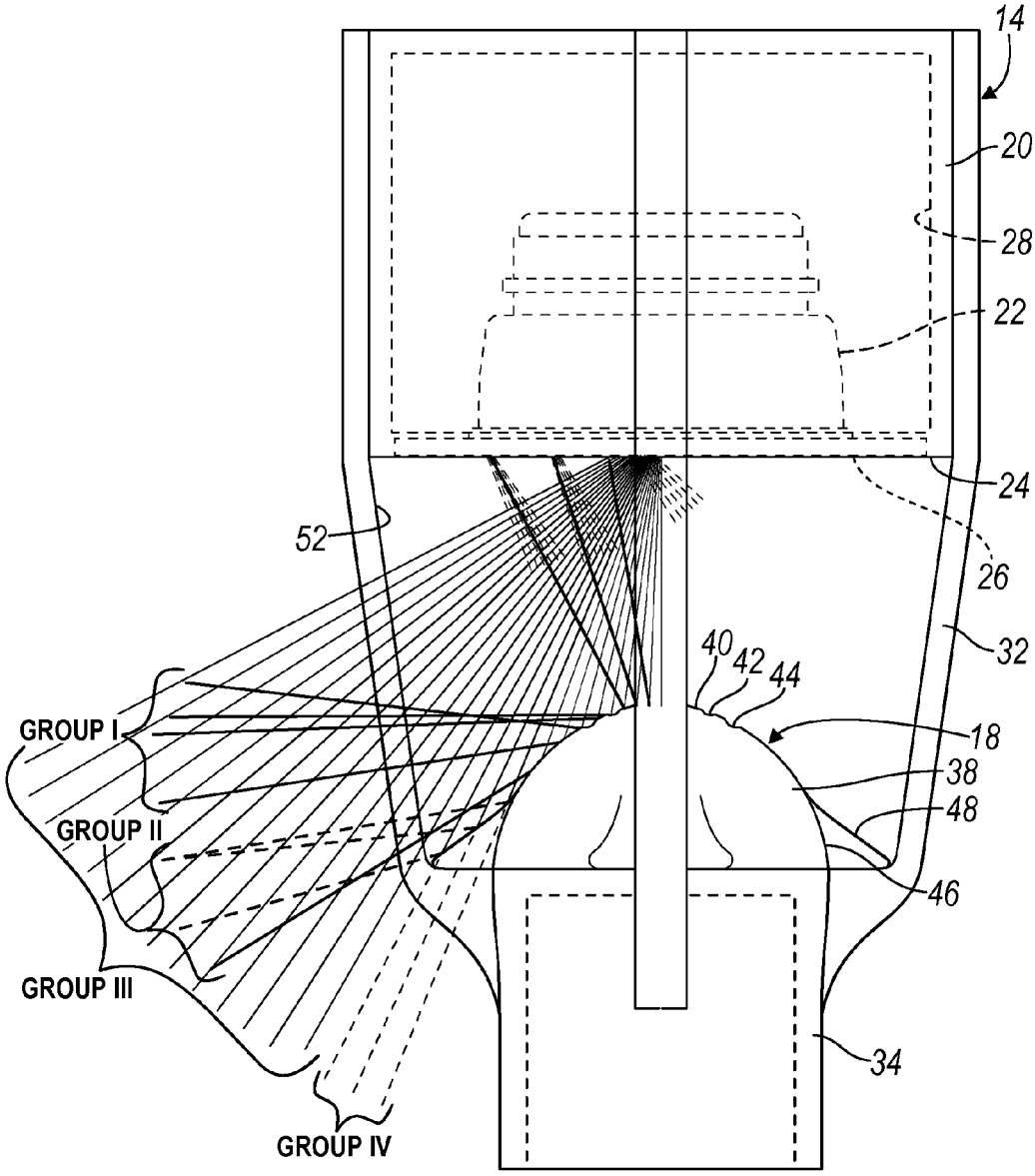
FIG. 3 is an enlarged front side elevation view of the media assembly of FIG. 1 illustrated further disassembled with a sound reflection pattern illustrated from a speaker upon an acoustic reflector.

Referring now to FIGS. 2 and 3, the media assembly 10 is illustrated with the luminaire 12 removed. The media assembly 10 includes a speaker housing 20 for housing a downward-facing speaker 22. The speaker housing 20 has an opening 24 for seating a mounting flange 26 of the speaker 22. The speaker housing 20 also provides a resonating chamber 28 for the speaker 22. The speaker housing 20 may include an adaptor 30 for mounting the luminaire 12 to the speaker assembly 14. Alternatively, the adaptor 30 may be employed for mounting the speaker assembly 14 to a luminaire and/or a structural support. In at least one embodiment, the luminaire 12 and the speaker housing 20 are formed integrally.

A series of support arms 32 extend from the speaker housing 20 and support the speaker housing 20 above the reflector 18. The support arms 32 may also support an adaptor 34 for mounting the media assembly 10 upon the structural pole 16. Alternatively, the top adaptor 30 may be employed for supporting the media assembly 10 upon a structural support, and therefore, the lower adaptor 34 may be employed for supporting a luminaire or some other media component.

FIG. 3 illustrates a distribution pattern for acoustic sound waves that are generated by the speaker 22. The distribution pattern includes reflected sound waves of various frequencies labeled as group I. The distribution pattern also includes reflected sound waves of a high frequency labeled as group II. The reflected sound waves of groups I and II are reflected from the reflector 18. The distribution pattern includes directly transmitted sound waves of various frequencies labeled as group III. High frequency directly transmitted sound waves are labeled as group IV. The directly transmitted sound waves of groups III and IV are not reflected from the reflector 18.

Figure 4:
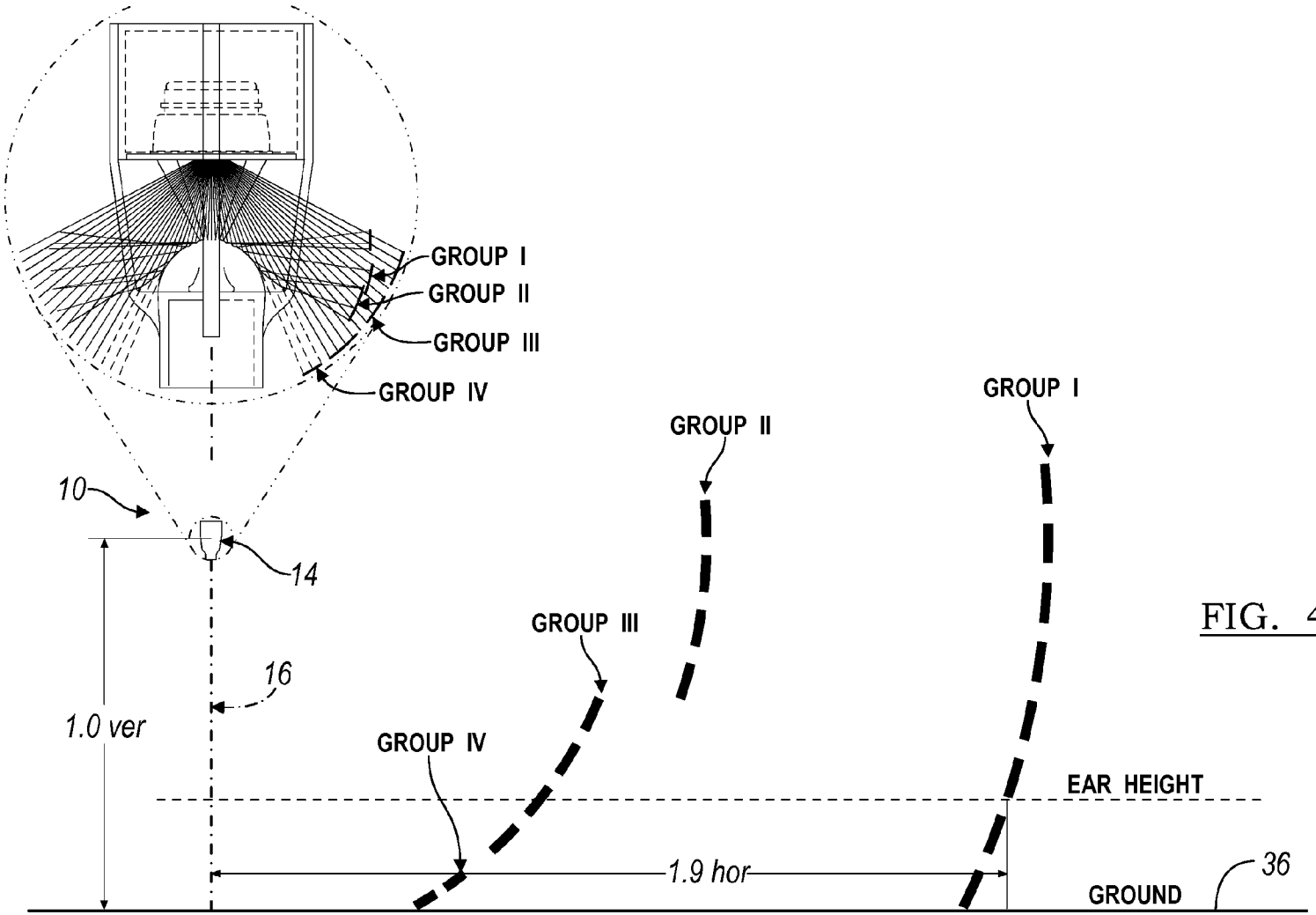
FIG. 4 is a schematic sound distribution pattern for the media assembly of FIG. 1.

FIG. 4 is a schematic illustrating the transmission of the sound wave groups in FIG. 3. The sound waves of group I are transmitted at an ear height above an underlying support surface 36 a distance that is approximately 1.9 times a height of the structural pole 16. An average ear height is approximately five feet above the underlying support surface 36. The high frequency reflected sound waves of group II are also illustrated above the ear height in FIG. 4. The directly transmitted sound waves of group III are illustrated intersecting the ear height less than half the distance obtained by the reflected low frequency sound waves of group I. The high frequency directly transmitted sound waves of group IV are illustrated intersecting the ear height near the pole 16. Thus, the reflector 18 is employed for providing an even distribution of the high and low frequency sound waves away from the pole 16 and near the base of the pole 16. Additionally, smooth audio distribution is provided in both a near field, such as within thirty degrees from nadir; and smooth audio distribution is provided in a far field, such as between thirty and one hundred degrees from nadir. In other words, the smooth audio distribution is equally distributed horizontally about the center of the speaker 22.

Figure 5:
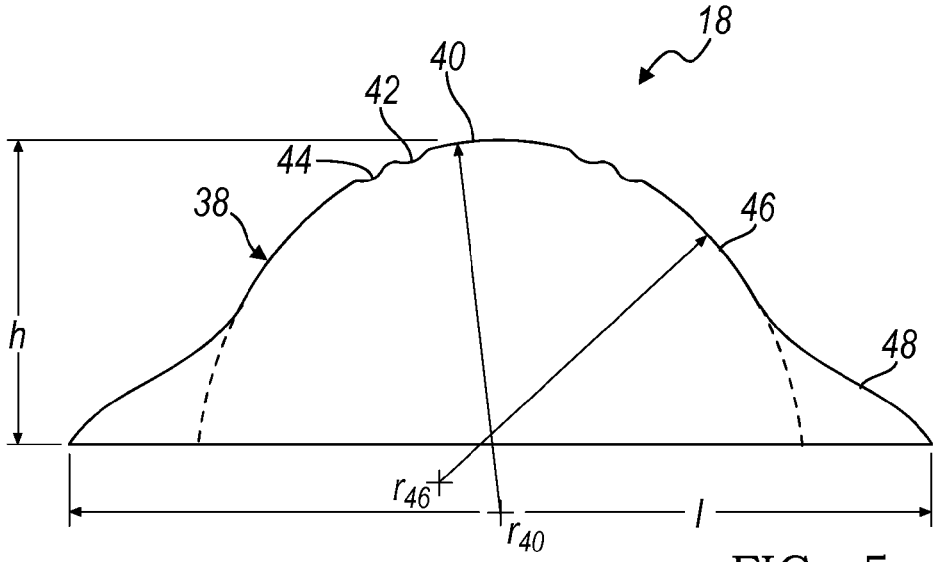
FIG. 5 is a front side elevation view of the acoustic reflector of FIG. 3.
Figure 6:
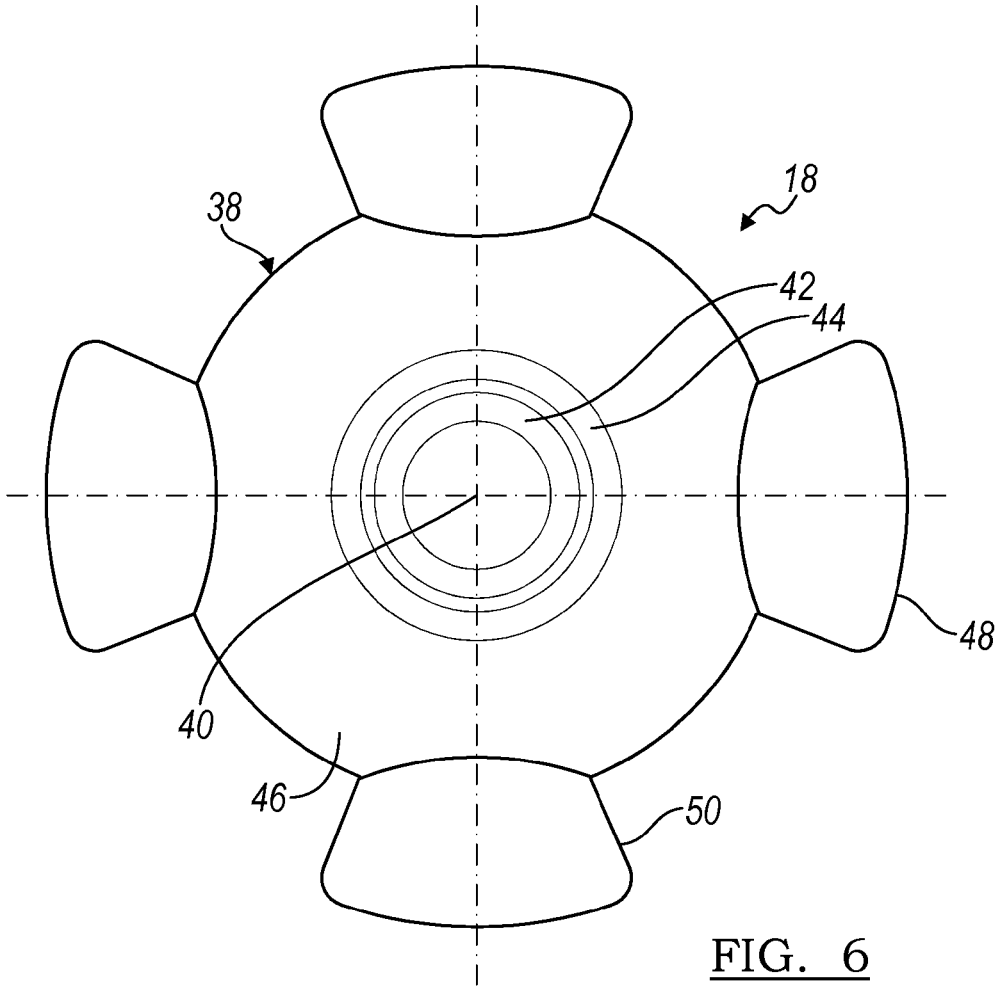
FIG. 6 is a top plan view of the acoustic reflector of FIG. 5.

FIGS. 5 and 6 illustrate the reflector 18 in greater detail. The reflector 18 includes a central dome 38. The dome 38 has a peak 40, which is bounded by a pair of coaxial annular recesses 42, 44. The peak 40 is employed for reflecting pressure and low frequency vibrations from the speaker 22 back to the speaker 22 for acoustically tuning the speaker 22, amplifying movement of the speaker 22, and minimizing the size of the associated resonating chamber 28. For example, the peak 40 is sized to enhance vibrations of frequencies within the range of 20 Hz to 1,500 Hz towards the speaker 22.

The annular recesses 42, 44 are employed for directing incidental sound waves in this region radially outward from the peak 40. Thus, the annular recesses 42, 44 provide a perimeter for the reflective surface of the peak 40. Midrange to high frequency vibrations reflect off the annular recesses 42, 44 and out of the speaker assembly 14. The annular recesses 42, 44 are contoured to direct the midrange to high frequency vibrations such that these frequencies avoid the speaker 22. The midrange and high frequency vibrations are in the range of 1,500 Hz to 20 kHz. Some of the low frequency vibrations also reflect off the peak 40 and out of the speaker assembly 14. Therefore, some of the low frequency vibrations are reflected into the speaker 22; while reflection of midrange to high frequencies into the speaker 22 is eliminated. The speaker 22 produces frequencies that are full range. Low frequency vibrations are enhanced by the peak 40 of the reflector 18, while all frequencies are affected and all frequencies have enhanced distribution due to the reflector 18.

Direct application of a cone speaker results in uneven sound distribution. In order to optimize efficiency for all frequencies, the dome 38 extends toward the speaker 22 to provide uniform distribution of the frequencies out of the speaker assembly 14. Additionally, the low frequencies are reflected back to the speaker 22. Air that is moved by the speaker 22 is reflected off the peak 40 of the dome 38 and back to the speaker 22. The reflected frequencies and air pressure amplify the back pressure of the speaker 22, thereby tuning the speaker 22. Additionally, by amplifying the back pressure of the speaker 22, a smaller resonating chamber 28 is permitted in comparison to resonating chambers that are sized for a speaker that does not have amplified back pressure. By reducing the size of the resonating chamber 28, the size of the speaker housing 20 is also reduced thereby minimizing the packaging required for concealing the speaker 22 and avoiding any drawback to the appearance of the overall luminaire 12 the and speaker assembly 14.

The dome 38 is generally hemispherically shaped. The peak 40 has a radius (2.25 inches, for example) greater than a height (1.84 inches, for example) of the reflector 18. An outboard region 46 of the dome 38 is utilized for reflecting sound waves away from the reflector, such as the low frequency sound waves of group II illustrated in FIGS. 3 and 4. The outboard region 46 may also have a radius (2.20 inches, for example) that is greater than the height of the reflector 18 and is offset from the center of the reflector 18. Overall, the dome 38 is generally convex for reflecting pressure back to the speaker 22 and reflecting sound waves radially outward from the reflector 18.

The reflector 18 also includes a series of lobes 48 each extending radially outward from the dome 38. The lobes 48 are circumferentially spaced and have a generally flat acoustically reflective surface for reflecting the high frequency sound waves of group II. The lobes 48 are provided interstitially about the perimeter of the dome 38 thereby providing gaps 50 between each sequential pair of lobes 48. The spacing of the lobes 48 and gaps 50 balances a distribution of the high frequency sound waves directed near the base of the support pole 16 and reflected away from the reflector 18. The gaps 50 permit the high frequency sound waves of group IV to pass between the lobes 48 to be conveyed to the underlying support surface 36. Thus, the lobe 48 and gaps 50 permit a balanced distribution of sound waves near the base of the pole 16 and away from the base of the pole 16.

In the depicted embodiment, the lobes 48 each have a uniform angular thickness that is equivalent to the angular spacing of the lobes 48 for an even distribution of the high frequency sound waves. Of course, the invention contemplates any variation of angular thickness of lobes 48 and angular spacing of the gaps 50 to control the distribution of the high frequency sound waves. Although the gaps 50 are illustrated between the lobes 48, the invention contemplates that the reflective surface of the lobes 48 may be provided circumferentially around the dome 38 with apertures formed therethrough for permitting the high frequency sound waves to pass. Although a radial array of four lobes 48 and four gaps 50 is illustrated, the invention contemplates any arrangement or array of lobes 48 and gaps 50.

Referring again to FIG. 3, empirical testing for a five inch diameter cone speaker has found ratios for tuning the relationship of the reflector 18 and the speaker 22. For example, a suitable ratio of an overall diameter of an acoustic reflective surface of the reflector to a diameter of the speaker is approximately 1.5 to 1. This relationship is scalable for cone speakers 22 of varying diameters. A suitable ratio of an overall diameter of the acoustic reflective surface of the reflector to a diameter of the central region is approximately 1.4 to 1. A suitable ratio of a diameter of an acoustic reflective surface of the reflector to a distance between the speaker and a peak of the central region of the reflector is approximately 2.2 to 1. Likewise a suitable ration of a diameter of the speaker to the distance between the speaker and a peak of the central region of the reflector is approximately 1.4 to 1. These ratios may be scaled for speakers 22 to varying diameters.

Referring again to FIGS. 1 to 3, the support arms 32 are each aligned with the lobes 48 as an example for maintaining a visual appearance of the lobes 48 and the associated support arms 32. Thus, the interstitial relationship of the lobes 48 and gaps 50 may be carried through the structure maintaining a uniform ornamental appearance. The spaced apart support arms 32 provide openings 52 between the support arms 32 for permitting sound to exit the media assembly 10. As illustrated in FIGS. 1 to 3, the lobes 48 extend radially outboard of a cross section of the dome 38 and the support poles 16 so that the gaps 50 are oriented directly at the underlying support surface 36.

With reference again to FIG. 1, the media assembly 10 provides a speaker assembly 14 with a concealed speaker 22 that is directed downward. Since the speaker 22 is directed downward, it is not exposed to the external environment and avoids collection of precipitation or external debris. By providing the speaker 22 coaxial to the pole 16 and the reflector 18, a symmetrical appearance is provided that is not obfuscated by an off center speaker assembly. Additionally, the symmetrical coaxial media assembly 10 and structural pole 16 has a uniform, uninterrupted structural integrity that does not increase wind loads or unintended collisions, which are associated with prior art speaker assemblies that are mounted off center from a pole.

The invention contemplates that the media assembly 10, may incorporate a variety of additional features beyond audio and lighting. For example, sensors may be employed to measure temperature, moisture, air quality, radiation, wind velocity and the like. Cameras may be utilized for surveillance or for live monitoring of the applicable thoroughfare. The media assembly 10 may also include receivers and/or transmitters, such as radio frequency or infrared, for analysis and/or on-site monitoring. Power and data interfaces or receptacles may be provided in the media assemblies for additional lighting (such as temporary or holiday lighting), signage, decorations, or the like. Each of these additional components may be oriented in the housings of the media assembly 10. The various features of the media assembly 10 may be controlled by the known techniques, such as those disclosed in Harwood U.S. Pat. No. 7,630,776 B2, the disclosure of which is incorporated by reference herein.

The media assembly 10 may be locally powered, self powered (such as solar or wind powered), or may be powered from a central amplifier. The reflector 18 may be opaque or translucent for illumination. The reflector 18 may be molded from an acrylic or formed from another acoustically reflective material. Although the speaker assembly 14 is illustrated between the luminaire 12 and the reflector 18, the invention contemplates various arrangements of the luminaire 12 speaker assembly 14 and reflector 18. The media assembly 10 may be utilized as an original installation, or may be utilized for retrofitting existing structural pole 16 for adding speaker assemblies 14.

Figure 7:
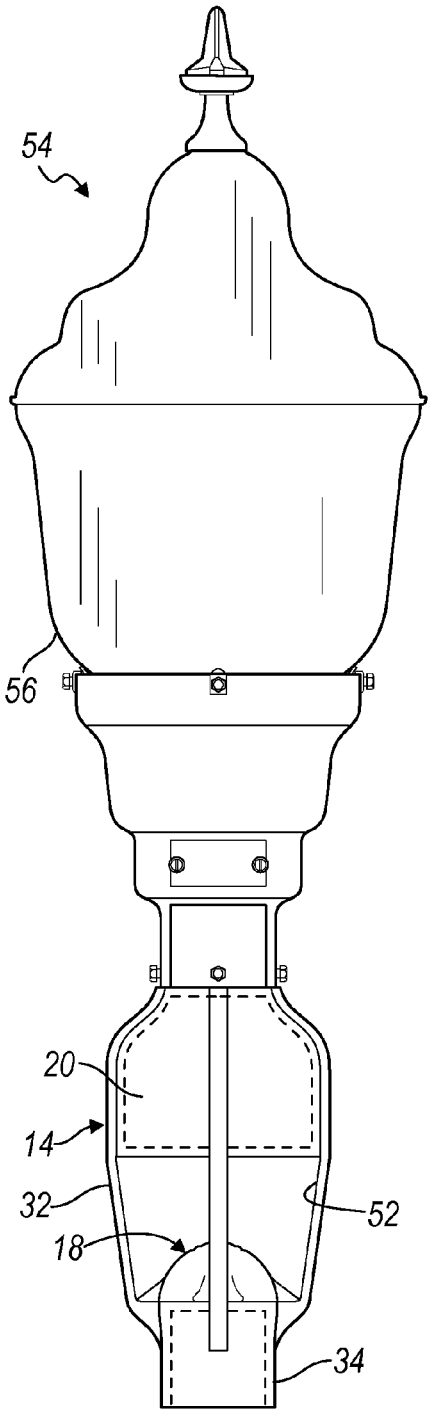
FIG. 7 is a front side elevation view of a media assembly according to another embodiment.

FIG. 7 illustrates another media assembly 54 having a different light assembly 56 in combination with the speaker assembly 14 and reflector 18. Thus the adaptors 30, 34 permit various installation options.

Figure 8:
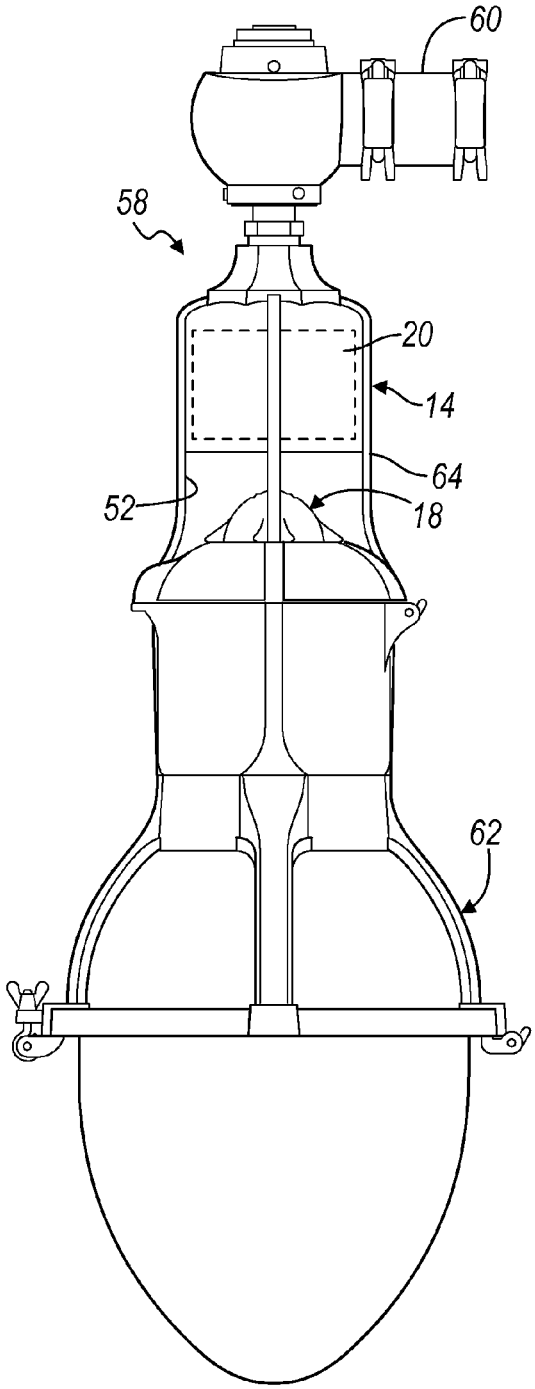
FIG. 8 is a front side elevation view of a media assembly according to yet another embodiment.

FIG. 8 illustrates yet another media assembly 58 having a structural support 60 above the media assembly 58 for hanging the media assembly 58. Thus, the reflector 18 is provided between the speaker assembly 14 and a luminaire 62. The luminaire 62 is supported by support arms 64 which extend from the structural support 60.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A speaker assembly comprising:

a speaker; and a reflector spaced apart from and facing the speaker, the reflector having a central region;

wherein the central region is generally convex;

wherein the speaker assembly further comprises a housing having a resonating chamber mounted to and in cooperation with the speaker such that pressure from the speaker is reflected from the central region to the speaker to amplify movement of the speaker and increase low frequency response; and wherein the central region of the reflector is generally hemispherical with at least one annular recess formed within the generally hemispherical central region for reflecting acoustic vibrations past and outboard from the reflector.

2. The speaker assembly of claim 1 further comprising a plurality of circumferentially spaced lobes, each extending radially outward from the central region for reflecting acoustic vibrations from the speaker radially outboard from the reflector while providing gaps between the lobes for permitting acoustic vibrations to pass therethrough.

3. The speaker assembly of claim 2 wherein each of the plurality of lobes has a generally uniform size;

wherein the plurality of lobes are equally spaced apart angularly; and wherein an angular thickness of each lobe is generally equal to an angular spacing between the lobes.

4. The speaker assembly of claim 1 wherein an acoustic reflective surface within a perimeter of the at least one annular recess, reflects the pressure back to the speaker.

5. The speaker assembly of claim 1 further comprising:

a housing mounted to the speaker; and a series of supports connecting the housing and the reflector, the supports being spaced circumferentially about the housing for providing openings between the supports for an outlet of the reflected acoustic vibrations.

6. The speaker assembly of claim 5 further comprising a plurality of circumferentially spaced lobes, each extending radially outward from the central region for reflecting acoustic vibrations from the speaker radially outboard from the reflector while providing gaps between the lobes for permitting acoustic vibrations to pass therethrough, wherein each of the series of supports is aligned with one of the lobes.

7. A media assembly comprising:

a structural support; and a speaker assembly according to claim 1 mounted upon the support.

8. The media assembly of claim 7 wherein the speaker is directed towards an underlying support surface.

9. The media assembly of claim 7 wherein the structural support further comprises a structural pole.

10. The media assembly of claim 7 wherein the structural support is sized to orient the speaker assembly at a height above an average ear height.

11. The media assembly of claim 7 further comprising a plurality of circumferentially spaced lobes, each extending radially outward from the central region for reflecting acoustic vibrations from the speaker radially outboard from the reflector while providing gaps between the lobes for permitting acoustic vibrations to pass therethrough, wherein the lobes extend radially outboard of the structural support.

12. The media assembly of claim 7 wherein the structural support has a cross-section that does not extend radially outboard beyond the central region of the reflector.

13. The speaker assembly of claim 1 wherein a ratio of an overall diameter of an acoustic reflective surface of the reflector to a diameter of the speaker is approximately 1.5 to 1.

14. The speaker assembly of claim 1 wherein a ratio of an overall diameter of an acoustic reflective surface of the reflector to a diameter of the central region is approximately 1.4 to 1.

15. The speaker assembly of claim 1 wherein a ratio of a diameter of an acoustic reflective surface of the reflector to a distance between the speaker and a peak of the central region of the reflector is approximately 2.2 to 1.

16. The speaker assembly of claim 1 wherein a ratio of a diameter of the speaker to a distance between the speaker and a peak of the central region of the reflector is approximately 1.4 to 1.

17. The speaker assembly of claim 1 wherein the at least one annular recess comprises a pair of annular recesses.

18. A media assembly comprising:

a structural support;

a housing mounted to the support;

a speaker mounted to the housing;

a series of support arms extending from the housing, the support arms being spaced circumferentially about the housing for providing openings between the support arms for an outlet of acoustic vibrations; and a reflector mounted to the series of support arms spaced apart from and facing the speaker, the reflector having a central region and a plurality of circumferentially spaced lobes, each extending radially outward from the central region for reflecting acoustic vibrations from the speaker radially outboard from the reflector while providing gaps between the lobes for permitting acoustic vibrations to pass therethrough, wherein each of the series of supports is aligned with one of the lobes.

19. The media assembly of claim 18 further comprising a light assembly mounted to one of the structural support, the housing, the series of support arms and the reflector for conveying light to an underlying region.

20. The media assembly of claim 19 wherein the speaker is oriented between the reflector and the light assembly.

* * * * *